United States Patent [19]

Segota

[11] Patent Number: 4,922,686

[45] Date of Patent: May 8, 1990

[54] VACUUM PACKAGING METHOD

[75] Inventor: Pietro Segota, Milan, Italy

[73] Assignee: W. R. Grace & Co., Duncan, S.C.

[21] Appl. No.: 747,400

[22] Filed: Jun. 21, 1985

Related U.S. Application Data

[63] Continuation of Ser. No. 433,319, Oct. 7, 1982, abandoned.

[30] Foreign Application Priority Data

Oct. 16, 1981 [IT] Italy ..... 24538 A/81

[51] Int. Cl.[5] ..... B65B 31/02

[52] U.S. Cl. ..... 53/434; 53/512

[58] Field of Search ..... 53/433, 434, 511, 512

[56] References Cited

U.S. PATENT DOCUMENTS

| | | | |
|---|---|---|---|
| 3,491,504 | 1/1970 | Young . | |
| 3,714,754 | 2/1973 | Holcombe et al. | 53/84 X |
| 3,832,824 | 9/1974 | Burrell | 53/417 |
| 3,851,437 | 12/1974 | Waldrop . | |
| 3,895,475 | 7/1975 | Wolfelsper . | |
| 3,965,646 | 6/1976 | Hawkins | 53/512 |
| 4,132,048 | 1/1979 | Day | 53/512 |
| 4,164,111 | 8/1979 | Bi Bernardo | 53/512 |
| 4,182,095 | 1/1980 | Day | 53/512 |
| 4,457,122 | 7/1984 | Atkins et al. | 53/434 |

FOREIGN PATENT DOCUMENTS

| | | | |
|---|---|---|---|
| 2161608 | 6/1972 | Fed. Rep. of Germany . | |
| 2247452 | 4/1974 | Fed. Rep. of Germany . | |
| 2409716 | 9/1975 | Fed. Rep. of Germany . | |
| 2750934 | 5/1978 | Fed. Rep. of Germany . | |
| 0173097 | 9/1975 | Netherlands . | |
| 2078658 | 1/1982 | United Kingdom | 53/434 |

*Primary Examiner*—Robert L. Spruill

*Attorney, Agent, or Firm*—William D. Lee, Jr.; Mark B. Quatt; John J. Toney

[57] ABSTRACT

A vacuum packaging process and apparatus employ the novel step of deliberately at least partially re-pressurizing the exterior of a packaging receptacle after commencement of the evacuation of the exterior and interior of the receptacle in a chamber. Preferably two separate gas pressure restoration phases are employed, separated by a resumption of the gas extraction, and the receptacle is closed during the second of these gas pressure restoration phases.

1 Claim, 3 Drawing Sheets

VACUUM PACKAGING METHOD

This is a continuation of Ser. No. 433,319, filed Oct. 7, 1982, now abandoned.

The present invention relates to a method of and apparatus for packaging an article in a receptacle to obtain a vacuum pack.

Hitherto it has been known to package an article in a plastics envelope, such as a plastic bag, by loading the article in the envelope and then inserting the loaded envelope into a vacuum chamber for the atmosphere around the envelope to be reduced in pressure so that the air or other gas within the envelope is extracted and finally the envelope can be sealed under low pressure conditions. The resulting package is termed a "vacuum package".

It is also known for the operation of the process to be such that during the reduction in pressure of the atmosphere around the envelope, the wall of the envelope balloons away from the enclosed article, so that the extraction of air from within the envelope can be more effectively carried out. Such a system has, for example, been disclosed in U.S. Pat. No. 3,714,754 (Holcombe) using a nozzle to extract air from within the envelope while the pressure of the atmosphere around the envelope has reduced to effect the necessary ballooning action. Ballooning has furthermore been disclosed in U.S. Pat. No. 3,832,824 (Burrell) in which the vacuum chamber in which the envelope is closed has two portions of which a first portion encloses the envelope mouth and the second portion encloses the article-enclosing remainder of the envelope so that the pressure around the exterior of the envelope can initially be reduced more rapidly than the pressure within the envelope (in order to promote the desired ballooning effect).

It has nevertheless been found that, with these prior art arrangements, there is a possibility for air to become trapped behind the product article and for pockets of such air to be trapped within the sealed pack.

It is an object of the present invention to provide an improved method and apparatus for packaging articles in a receptacle so as to overcome this disadvantage of the prior art.

Accordingly, the present invention comprises a process of vacuum packaging an article in a receptacle, comprising loading the article in the receptacle, extracting gas from around the exterior of the receptacle to lower the surrounding pressure, extracting gas from within the receptacle, and closing the receptacle in a gas-tight manner after the extraction of the gas from its interior, characterised by partially restoring the pressure surrounding the exterior of the receptacle, then further extracting gas from both around the exterior of the receptacle and within the receptacle, and again partially restoring the gas pressure surrounding the exterior of the receptacle during further removal of gas from within the receptacle, before closing the receptacle.

A further aspect of the present invention provides apparatus for vacuum packaging, comprising a vacuum chamber having an extraction pump for extracting gas from within the interior of the chamber and a support for a loaded receptacle to be evacuated and sealed in the chamber; and means for closing a receptacle in the chamber; characterised by means for restoring gas pressure to the exterior of a receptacle disposed within the vacuum chamber after partial evacuation of the chamber by the extraction pump, and in that the gas pressure restoration means are effective to carry out at least two gas pressure restoration phases separated by a gas extraction step during which gas is extracted from within the chamber by the extraction pump. Suitably said gas pressure restoration means comprises a gas admission valve connected to the space evacuated by the extraction pump.

In order that the present invention may more readily be understood the following description is given, merely by way of example, with reference to the accompanying drawings in which.

Figure 1:
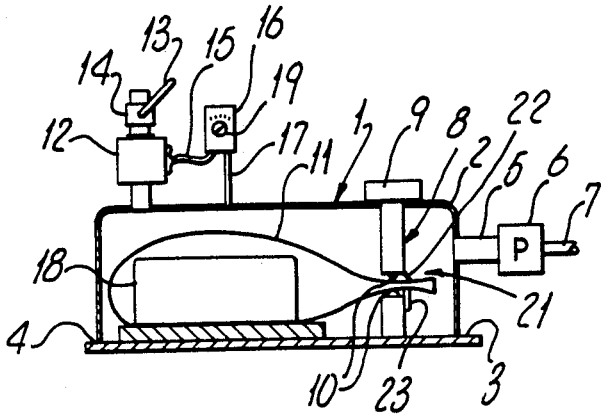
FIG. 1 is a schematic side elevational view of a first embodiment of vacuum packaging apparatus in accordance with the present invention.

The vacuum chamber 1 shown in FIG. 1 is of a conventional form and includes a vacuum enclosure comprising a cover 2 on a base 3 to which the cover is sealed along its rim 4. An air extraction duct 5 leads to an extraction pump 6 whose discharge duct 7 conveys away air which has been extracted from the chamber 1.

The chamber further includes a receptacle-closing unit 8 having a drive mechanism 9, here comprising a pair of opposed hot weld bars 10 which are driven towards one another to contact the neck region of the receptacle 11 (in this case a plastics bag of heat shrinkable thermoplastic material) and are energized with a pulse of electric energy to heat seal the neck region of the envelope before the chamber 1 opens.

This embodiment of the present invention provides for the incorporation of an air admission valve 12 on the chamber cover 1 to admit air into the chamber while the extraction pump 6 is in operation. This unexpected modification has the surprising advantage of being able to allow more effective extraction of air from within the receptacle 11 provided the operation of the air admission valve is operated in accordance with the process of the present invention.

The air admission valve 12 includes an airflow regulator lever 13 allowing a throttle 14 to be adjusted to give the desired rate of venting of the valve 12 when in its open configuration. Furthermore, the valve 12 is connected, by pneumatic control line 15, to a pneumatic control unit 16 which provides signal pulses to the valve 12 in response to the vacuum level in the chamber 1 as sensed by way of a sensing conduit 17. It is expected that the rate of admission of air through the throttle 14 will be greater than the rate of extraction by the pump 6.

The control unit 16 for the air admission valve 12 includes a selector control 19 allowing adjustment of the particular value of the residual pressure within the chamber 1 at which the valve 12 is opened and closed.

As will be indicated below, making the control unit 16 responsive to the chamber pressure is an optional feature, although this type of control does provide a particularly convenient way of controlling the operation of the air admission valve 12 when carrying out the process of the present invention.

To perform the process in accordance with the invention, the chamber cover 2 is closed over the open receptacle 11 with article 18 therein, and the extraction pump 6 is energized to begin extraction of air from within the chamber 1 and consequently from within the receptacle 11 (by virtue of the neck region being open between the two spaced welding bars 10 of the closing mechanism 8).

Ideally the welding bars 10 are, during extraction, spaced apart such that air is extracted at a controlled rate from within the receptacle 11 and this rate of extraction is less than the rate of pressure decrease in the atmosphere within the chamber 1 but around the exterior of the receptacle 11, with the result that the receptacle 11 balloons outwardly away from the article 18.

According to the invention, the air admission valve 12 should then be opened in order to vent air into the chamber 1 (preferably by simply opening the chamber 1 directly to atmosphere to allow atmospheric air to mix with the residual atmosphere around the exterior of the receptacle 11). Where the receptacle has already ballooned away from the article, this venting has the result that the receptacle 11 is pressed inwardly against the exterior of the article 18.

During this gas pressure restoration phase, the extraction of air from within the receptacle 11 will continue and in the case of a flexible bag 11 the thrusting of the flexible bag material 11 onto the product article helps to "pump" air from within the bag 11. The operation of the air admission valve and the extraction pump, as well as of the receptacle closing means 8 is controlled by a programmer 20 which maintains the pump 6 in operation even during gas pressure restoration phases.

The air pressure restoration phase is of limited duration so that when the air admission valve 12 is re-closed the continuing operation of the extraction pump 6 will effect extraction of the now slightly higher pressure atmosphere around the bag 11, while still evacuating the lower pressure interior of the bag 11. This extraction of the external air from around the bag 11 may shortly result in recurrence of the ballooning phenomenon, whereupon the air admission valve 12 is once again opened to build up gas pressure around the bag 11 to thrust the bag material onto the article 18 to achieve a pulsating reinforcement of the air extraction from within the bag 1.

It is envisaged that this pulsating action of successive pressure reductions followed by pressure increases on the exterior of the receptacle can continue until a desired configuration has been obtained at which time the receptacle 11 is closed by operation of the closing means 8 when its actuating means 9 are energized. However, it is preferred for the cycle to continue for only two re-pressurization pulses, even though the use of more than two such pulses is within the scope of the present invention.

Figure 2:
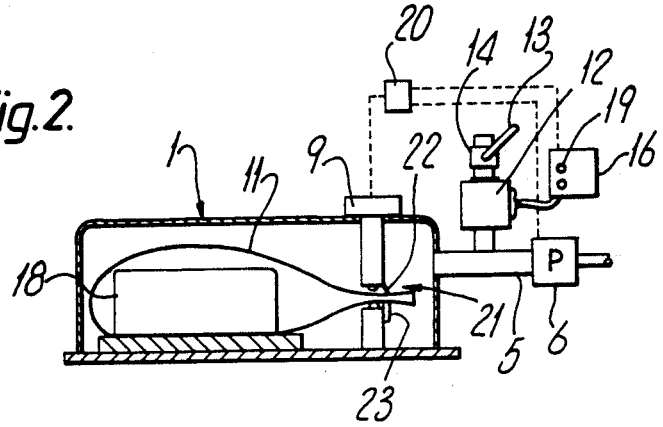
FIG. 2 is a view similar to FIG. 1 but showing a second embodiment of apparatus in accordance with the invention.

FIG. 2 illustrates an alternative embodiment of the apparatus in accordance with the present invention, differing only in that the air admission valve 12 is connected in the extraction duct 5 to the pump 6. The functional result will be the same in that the successive opening and closing of the air admission valve 12 superimposed on the continuous operation of the extraction pump 6 will achieve a pulsating pressure in the residual atmosphere around the receptacle 11 in both FIG. 1 and FIG. 2. It will of course be understood that the air admission valve 12 in FIG. 1 need not be incorporated on the cover 2; air admission means of any suitable form could be used, for example a valve connected to an air admission port in the base 3 inwardly of the position occupied by the rim 4 of the cover 2 in the closed configuration of the chamber.

The embodiment of FIG. 2 also includes an adjustable throttle valve 14 having a control lever 13, and an adjuster 19 on the control unit 16 for selecting a different pressure value at which the air admission valve 12 is to open or close.

Although, in FIG. 1 and in FIG. 2, the air admission valve 12 is operated in response to attainment of particular pressure value in the chamber 1, as indicated above, it is not essential for the control of the air admission valve to be responsive to chamber pressure. For example, the control unit 16 may be a pulsing controller of a pneumatic type which imposes pressure or suction pulses on the control line 15 to the air admission valve 12 at predetermined time intervals after commencement of the evacuation of the chamber 1. Alternatively, the control unit 16 may not be pneumatic but may be connected to the valve 12 by a mechanical linkage or by an electrical linkage, in which case the pressure- or time-responsive controller will be of a mechanical or an electrical type, respectively. Yet a further possibility suitable where the receptacle is a plastic envelope is for a mechanical feeler unit to be incorporated within the chamber 1 in order to detect when the flexible envelope such as bag 11 balloons, since the ballooned state of the bag 11 at the instant of the opening of the air admission valve 12 assists the extraction operation.

Figure 3:
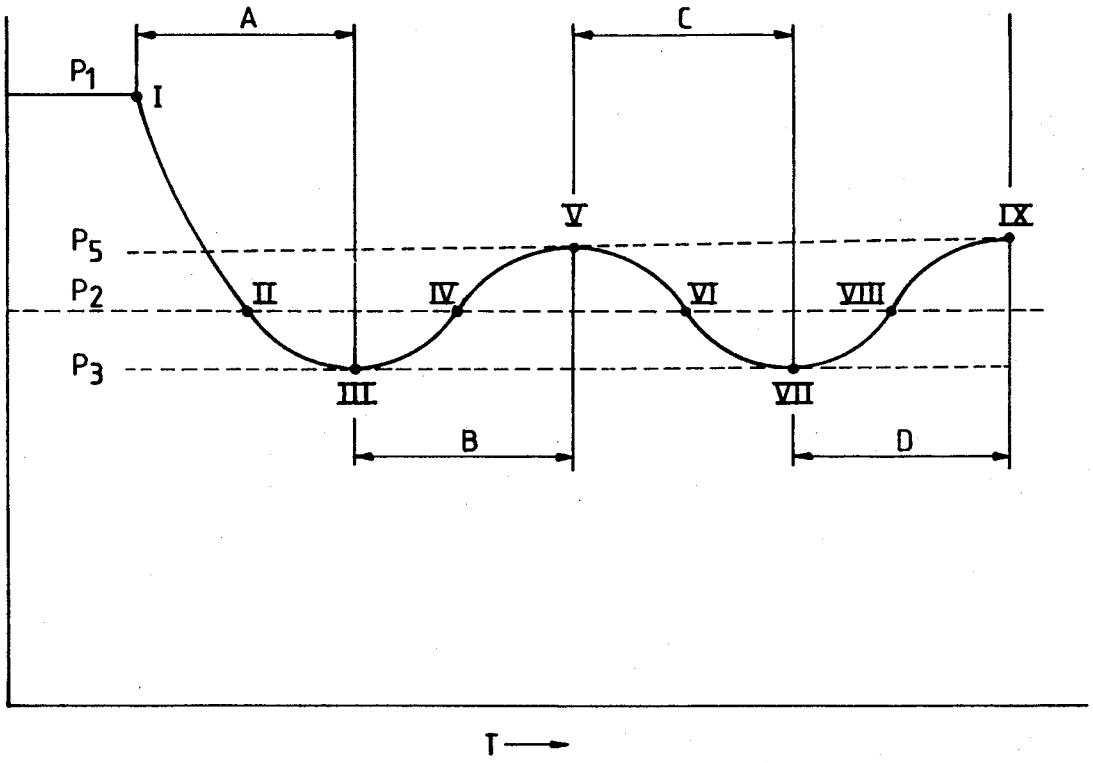
FIG. 3 is a cycle timing diagram showing the residual pressure P in the chamber plotted against time T of the cycle.
Figure 4:
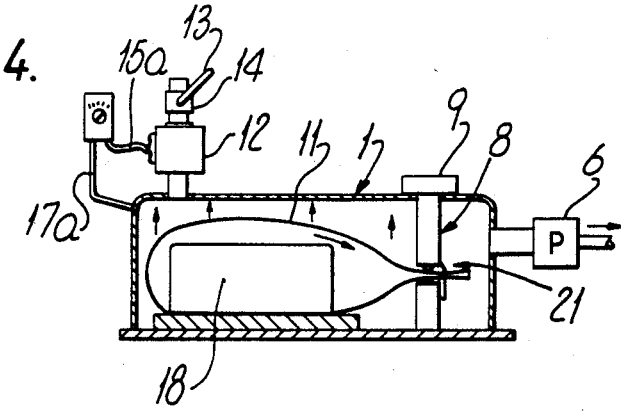
FIG. 4 is a view similar to FIG. 1 but showing the apparatus during operation of the vacuum pump and with the air admission valve closed.
Figure 5:
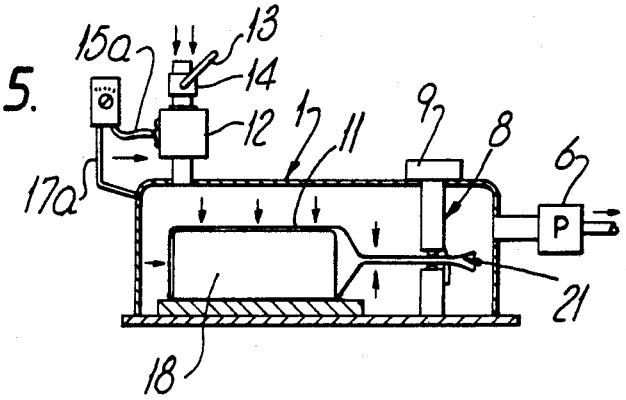
FIG. 5 is a view similar to FIG. 4 but showing the effect of the air admission valve in the open configuration.
Figure 6:
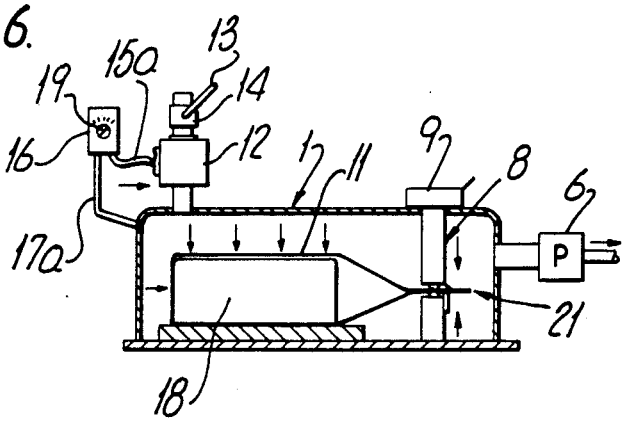
FIG. 6 is a view similar to FIG. 5 but showing the envelope-closing mechanism in operation.

Throughout the following description, the mechanism of FIG. 1 for use with plastics flexible bags 11 will be described in its detailed operating cycle, with reference to the cycle diagram of FIG. 3 and with reference to FIGS. 4, 5 and 6 showing the apparatus of FIG. 1 at different states in its operating cycle. It will of course be appreciated that the different location of the control line 15*a* and the sensing line 17*a* in FIGS. 4 to 6 with respect to the positions of the corresponding lines 15 and 17 in FIG. 1 is of no functional significance but is simply to illustrate the fact that the routing of these lines is purely optional at the discretion of the machine designer.

FIG. 3 shows that at the start of a typical operating cycle the pressure within the chamber is at a value $P_1$,normally the atmospheric pressure in the packaging room.

The machine is set up by adjusting the throttle control lever 13 to give the desired air admission rate, and also adjusting the pressure control 19 to select a particular pressure at which the control unit 16 operates to create a signal pulse in control line 15. This pressure $P_2$ is shown in FIG. 3.

Referring now to the operating cycle depicted in FIG. 3, once that chamber 1 is closed the pressure P reduces from initial value $P_1$ at point I to a value $P_2$ which has been pre-set on the control 19, and at which the control unit 16 sends a signal pulse to the valve 12. As this pulse is being transmitted to the valve 12, the pressure P is still reducing below the value $P_2$ between point II and point III on the pressure/time curve. The opening of the air admission valve 12 will, however, result in a reduction in the rate of extraction of air by the pump 6 and consequently the pressure P bottoms out at a value $P_3$ at point III, and then begins to rise towards the value $P_2$ which is attained at point IV on the curve. At this point the control unit 16 emits another signal pulse closing the air admission valve 12, but nevertheless there remains an upward swing in the pressure value towards the point V on the curve. This upward swing flattens out at point V at pressure value $P_5$, and the pressure then begins to reduce towards point VI on the curve. The above-described sequence of events between points II, III, IV and V is repeated between points VI, VII, VIII and IX. However, somewhere between points VII and IX the receptacle-closing unit 8 is operated to seal the bag 11 while the pressure around the bag is increasing and pumping out residual air from within the envelope. This is a preferred aspect of the invention and ensures optimum elimination of trapped bubbles of air or other gas from within the bag 1.

It is particularly preferable for the programmer 20 to trigger the closing action to occur between points VIII and IX, so that the repressurization pulse on the envelope has had a chance to build up momentum.

It will readily be appreciated that the flexible bag 11 balloons at some stage between points I and III, collapses between points III and V, balloons again between points V and VII and collapses between points VII and IX.

Where a particularly high vacuum (low residual pressure) is required within the bag 11, it may be envisaged that the receptacle-closing means 8 are operated between points VI and VII or between corresponding points on a further descending half cycle of the curve after point IX.

The process described above has been performed successfully for the packaging of cheese where a relatively "soft" vacuum is advantageous but where the size of the cheese pack may be such that conventionally the air extraction operation takes a considerable time. It has been found that the extraction time is reduced with the process in accordance with the present invention and the occurrence of trapped gas pockets in the pack (particularly likely in the case of Emmental cheese having cavities formed in the surface of the cheese block) is reduced. Although the present invention is not to be limited by any speculation on the functional advantages of the process, it is thought that the inward and outward oscillation of the wall of the receptacle (in the case of a flexible bag 11) due to the pulsating pressure on its exterior results in a pumping action which urges escape of gas (e.g. air) through the neck of the bag 11 with great momentum while the bag is still ballooned, and that this assists in persuading trapped gas pockets to escape. Furthermore, this ensures that the residual pressure right through the pack is more uniform than is possible with prior art vacuum packaging processes.

It is envisaged that the present invention will be equally applicable to high vacuum (low residual pressure) packaging as to "soft vacuum" packaging (with relatively higher residual pressure values).

FIG. 4 illustrates the condition of the apparatus between points I, II and III of the cycle diagram of FIG. 3. This same configuration applies between points V, VI and VII. The extraction pump 6 is in operation but the air admission valve 12 is closed.

FIG. 5 illustrates the configuration between points III, IV and V in the cycle diagram of FIG. 3. This configuration is repeated between points VII, VIII and IX. The air admission valve receives a signal along the signal line 15*a* and opens to admit air into the chamber 1.

FIG. 6 illustrates the configuration at one instant during the interval between points VIII and IX, shortly before point IX, when the control unit 16 transmits a signal pulse along the signal line 15*a* and closes the air admission valve 12 while the receptacle-closing means 8 are actuated to seal the envelope.

If desired, the sealed receptacle 11 may be subjected to a shrinking operation to cause the receptacle material to contact the article 18 intimately.

Although it is envisaged that the apparatus in accordance with the present invention may be equipped from the outset with repressurization means such as the air admission valve 12, it is also within the scope of the present invention for an existing vacuum chamber machine to be modified, simply by the addition of repressurization means such as the air admission valve 12 (and suitable control means therefor) either on the chamber 1 or on the extraction conduit 5, so as to modify that existing machine to operate in accordance with the process of the present invention.

Although, in the above description, the envelope-closing means 8 comprises a heat sealing bar arrangement, other suitable closing mechanisms may be provided, for example radiant heat fusion sealing means operating in conjunction with a resilient clamp to allow escape of air from within the receptacle 11 before the emission of a radiant heat pulse to cause the receptacle to fuse upon pressing contact with itself by the increasing pressure in the chamber 1 between points VII and IX of FIG. 3.

Other closing systems such as a gathering and clipping mechanism may instead be provided. Likewise, although the apparatus illustrated in FIGS. 1, 2, 4, 5 and 6 shows a single, open chamber, it is of course possible for the process of the present invention to be carried out using the "in-chamber nozzle" disclosed in the above mentioned U.S. Pat. No. 3,714,754 (Holcombe), or in the double chamber construction disclosed in the above mentioned U.S. Pat. No. 3,832,824 (Burrell).

As mentioned above, the operation of the air admission valve 12 may be controlled simply on the basis of time elapsed since the start of the cycle, or in response to operation of a mechanical feeler, and both of these control mechanisms can be incorporated as modifications to existing vacuum chamber packaging equipment.

I claim:

1. In the process of vacuum packaging articles in flexible receptacles by placing the filled, unsealed receptacle in a vacuum chamber, lowering the pressure below atmospheric thereby ballooning the receptacle away from the article, and, subsequently, raising the pressure in the chamber to collapse the receptacle onto the article and sealing the receptacle, the improvement which comprises after the pressure has been lowered and raised in a first cycle and before the receptacle is sealed the additional steps of lowering and raising the pressure through at least one additional cycle of lowered and raised pressure to cause the receptacle to alternately balloon away from and collapse upon the article thereby pumping residual air from within the receptacle and, thereafter, sealing the receptacle.

* * * * *